US006064016A

United States Patent [19]

Muzslay

[11] Patent Number: 6,064,016

[45] Date of Patent: May 16, 2000

[54] WIPER SWITCH TERMINAL AND CONTACT

[75] Inventor: Steven Zoltan Muzslay, Huntington Beach, Calif.

[73] Assignee: ITT Manufacturing Enterprises, Inc., Wilmington, D.C.

[21] Appl. No.: 09/128,686

[22] Filed: Aug. 4, 1998

[51] Int. Cl.[7] ..... H01H 1/26

[52] U.S. Cl. ..... 200/242; 200/283; 200/535

[58] Field of Search ..... 200/242, 239, 200/245, 250, 574, 573, 283, 284, 532, 535, 546, 559, 569

[56] References Cited

U.S. PATENT DOCUMENTS

| | | | |
|---|---|---|---|
| 2,717,297 | 9/1955 | Walker | 200/242 |
| 2,754,393 | 7/1956 | Clair, Jr. . | |
| 3,567,891 | 3/1971 | Hinkelmann . | |
| 3,689,856 | 9/1972 | Lambert et al. | 335/133 |
| 3,800,104 | 3/1974 | Lien et al. | 200/5 A |
| 3,911,716 | 10/1975 | Weglin | 72/324 |
| 4,042,795 | 8/1977 | Sykora | 200/16 D |
| 4,070,555 | 1/1978 | Carli | 200/6 B |
| 4,220,835 | 9/1980 | Storz et al. | 200/283 X |
| 4,336,429 | 6/1982 | Jackson et al. . | |
| 4,405,845 | 9/1983 | Kondo et al. . | |
| 4,431,884 | 2/1984 | Flumignan et al. . | |
| 4,480,937 | 11/1984 | Eckhardt | 200/535 X |
| 4,514,609 | 4/1985 | Fricke et al. . | |
| 4,894,499 | 1/1990 | Beck et al. | 200/404 |

*Primary Examiner*—Renee S. Luebke
*Attorney, Agent, or Firm*—Thomas L. Peterson

[57] ABSTRACT

A switch is provided that includes a circuit board support (12) with a contact bump (24, 26) thereon, and a sheet metal terminal (16) having a deflectable blade (20,22) with an elongated H-shaped slot (70). The slot forms rear and front tines (72, 74) with adjacent free ends (84, 86) that lie over the bump, to contact the bump when the front end of the blade is allowed to move towards the support.

9 Claims, 2 Drawing Sheets

WIPER SWITCH TERMINAL AND CONTACT

BACKGROUND OF THE INVENTION

Vehicles commonly have windshield wiper blades whose operation is controlled by a remotely operated switch. The switch includes a sheet metal blade that is mounted on a board that also holds a contact under a front end of the blade. A rotatable cam deflects the blade front end to move the blade away from the contact to open a circuit that controls energization of the windshield wiper motor. This type of switch is found to occasionally malfunction due to a high-resistance path between the blade and contact. The environment of the switch is often dusty, and a dust particle may come between the blade and contact. The contact is commonly formed of silver to avoid corrosion while the blade is often formed of beryllium copper for high resilience. Occasional corrosion also can result in insufficient current passing between the contacts to operate the windshield wiper motor. A contact blade which could be substituted for the present contact blade, and which greatly reduced high resistance contact, would enable an upgrading of the present switch at minimum cost.

SUMMARY OF THE INVENTION

In accordance with one embodiment of the present invention, a switch is provided that includes a switch terminal mountable on a support that also holds a contact, where the switch terminal provides reliable low resistance engagement with the contact when moved thereagainst. The terminal is a piece of sheet metal and forms a longitudinally-elongated blade. The blade rear end portion, which forms a mount for holding to the support, has an elongated deflectable part for resilient bending of the blade. The blade has a free-front end that can be deflected to open and close the switch and the blade has a middle. The blade middle forms a longitudinally-elongated slot, with a main middle portion that completely surrounds the slot and a longitudinally-elongated tine. The tine has a free end lying below the middle portion and engaging the contact on the support.

The slot in the blade is preferably H-shaped to form a pair of tines with free ends lying below the main middle portion that surrounds the slot. The contact is preferably in the form of a largely part-spherical bump, and the free ends of the tines preferably engage the bump on longitudinally opposite sides of the high point of the bump.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
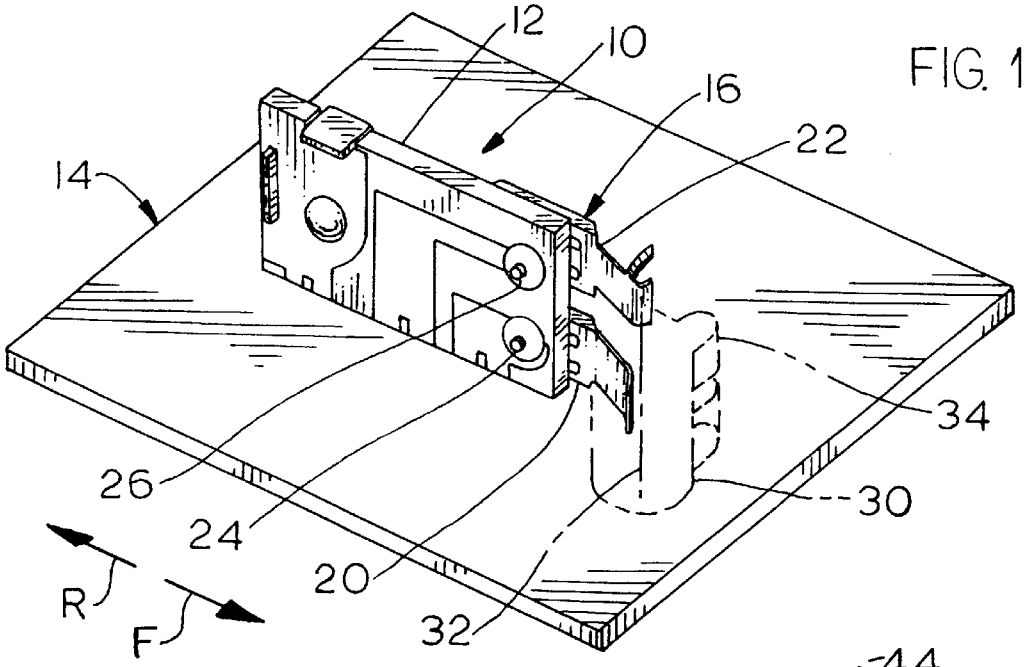
FIG. 1 is an isometric view of a switch constructed in accordance with the present invention, showing, in phantom lines, a switch cam that can be rotated to operate the switch.

FIG. 1 illustrates a remotely operated switch 10 of a type used in vehicles to control a windshield wiper motor. The switch includes a support 12 in the form of a small circuit board which is mounted on a larger mother board 14. The switch includes a terminal 16 having a pair of blades 20, 22 that engage contacts 24, 26 mounted on the support. A cam member 30 that can be rotated about an axis 32 by a motor (not shown) has cams 34 that can deflect the switch blades 20, 22 out of engagement with the contacts 24, 26.

Figure 2:
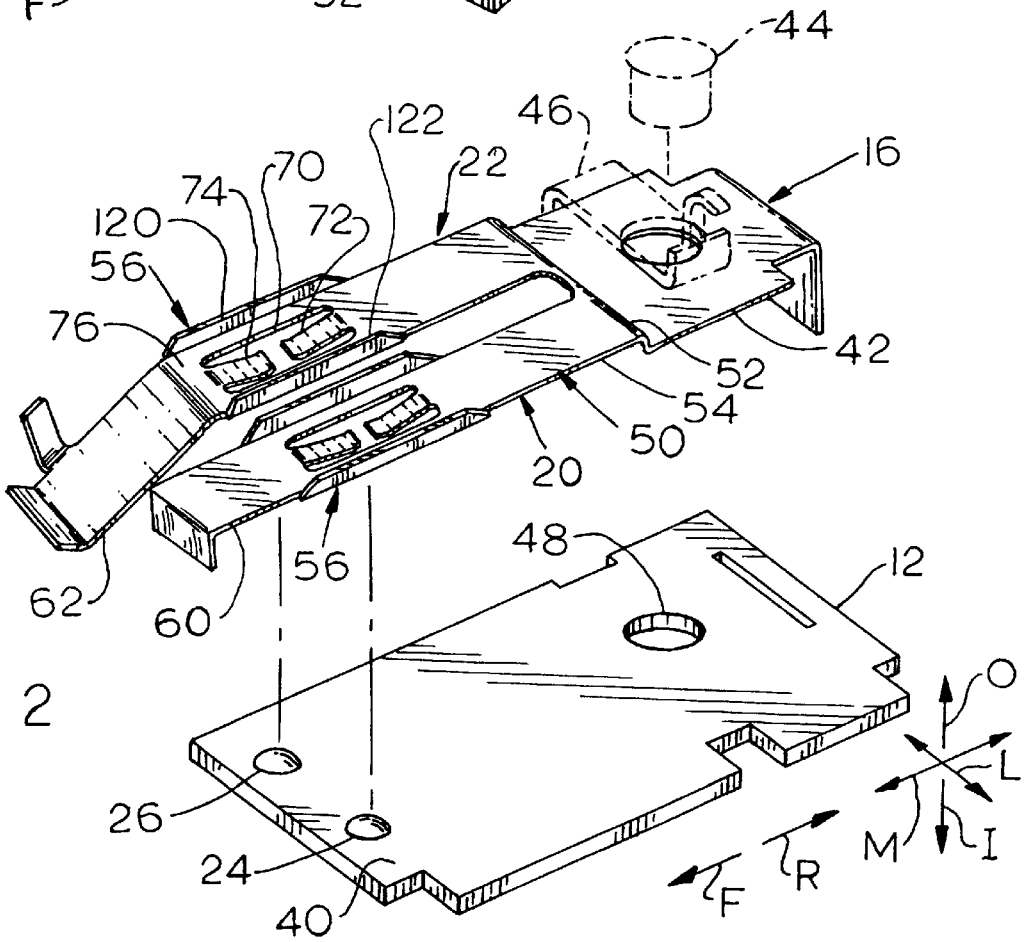
FIG. 2 is an exploded isometric view of the switch of FIG. 1.

As shown in FIG. 2, each of the contacts 24, 26 is in the form of a bump that is raised above the surrounding flat surface 40 of the support 12. The terminal 16 is formed from a piece of sheet metal and has a mount 42 that is pressed facewise against the support surface 40. The mount is held to the support surface by a rivet 44 that extends through holes in a contact plate 46 and in the mount 42, and through a hole 48 in the support, with the inner end of the rivet being deformed to hold it in place.

Each of the blades 20, 22 has a rear blade end portion 50 with a blade mount part 52 that is part of the mount 42 where the blade is fixed in position. The rear end portion also includes a longitudinally M elongated deflectable part 54 extending in a forward F longitudinal direction from the blade mount part, to a middle 56 of the blade, where the blade can engage the contact 24. The blade also has a free front end portion 60 which is free to deflect, and which is designed to be deflected by a cam to move the middle 56 out of engagement with the contact 24. The second blade or blade part 22 is laterally L spaced from the first blade part and extends parallel thereto. The second blade 22 is substantially identical to the first blade, although its free front part 62 is differently shaped for engagement by a different cam on the cam member.

Figure 3:
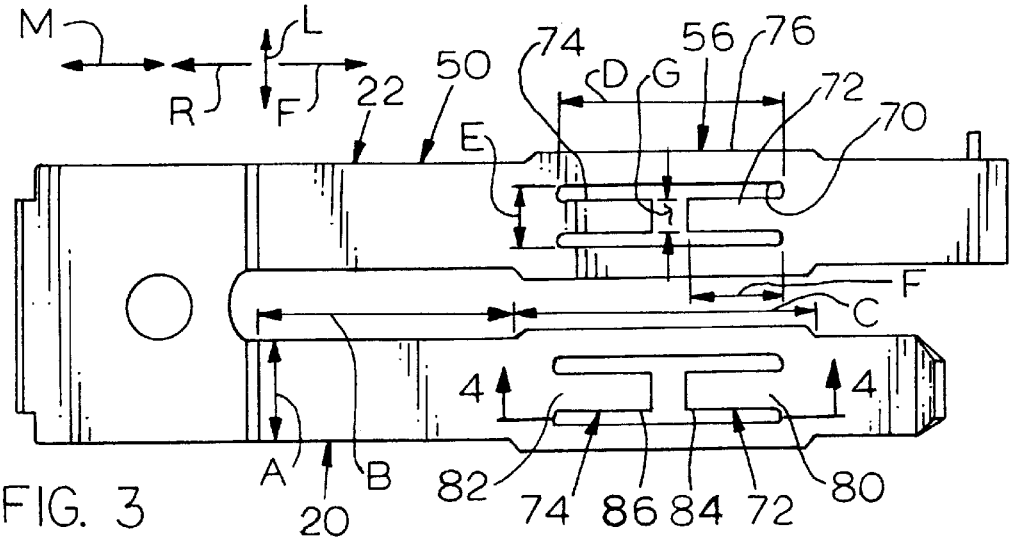
FIG. 3 is a bottom view of the terminal of the switch of FIG. 2.

As shown in FIG. 3, the middle 56 of each blade has a longitudinally elongated slot 70 that is preferably H-shaped. The H-shaped slot, which is longer in the longitudinal direction M than in the lateral direction L, forms front and rear tines 72, 74, and forms a main middle portion 76 that completely surrounds the slot. Each tine has a supported end 80, 82 and has an opposite free end 84, 86, with one tine lying directly forward F or rearward R of the other and with the tine free ends being slightly spaced apart. As mentioned above, the rear end portions 50 and middle 56 of the two blades 20, 22 are substantially identical, so a description of the middle of one applies to the other.

Figure 4:
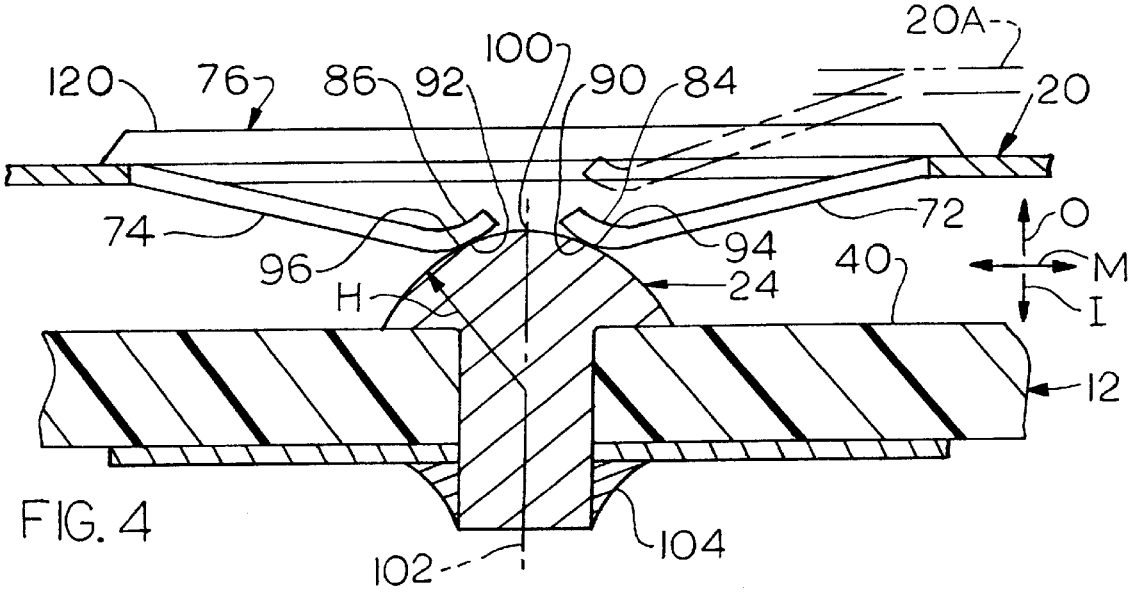
FIG. 4 is a view taken on line 4—4 of FIG. 3, and showing the tines fully engaged with a contact on the support.

As shown in FIG. 4, each tine 72, 74 has a portion that extends at a downward or inward I incline towards the support surface 40, which assures that the tine free ends 84, 86 will engage the contact without interference from the main middle portion 76. The tine free ends are bent to have convex inner surfaces at blade contact points 90, 92 that directly engage locations 94, 96 on the contact. The locations 94, 96 on the contact lie on longitudinally opposite sides of a contact high point 100 that lies along an axis 102 of the contact, with the high point 100 lying furthest (in the outward direction O) from the plane of the substantially flat support upper surface 40. This arrangement results in longitudinal forces on the two tines being in opposite directions and cancelling each other.

The arrangement shown in FIG. 4 results in increased reliability for a few reasons. First, the arrangement provides two contact points where the blade such as 20 engages the contact. Thus, if a dust particle lies between one of the tine free ends 84, 86 and the contact, low resistant engagement of the blade with the contact will still occur at the other tine outer end. Second, as the blade moves inwardly from a deflected position 20A back to the position shown in solid lines in FIG. 4, the tine contact points 90, 92 slide along the contact resulting in a wiping action that tends to remove dust particles and any corrosion at the contact point. Third, the convex tine contact points such as 90 and the bump locations such as 94 are both convexly curved, resulting in high localized pressure. It is noted that when a contact with a curved end engages a flat surface, there will be concentrated forces, although repeated engagement and disengagement tends to wear a flat surface on the contact. The presence of a rounded contact results in curved contact points remaining for longer periods of time. The bump-shaped contact 24 is largely part of a sphere, in that there is no abrupt corner where the radius of curvature changes drastically (to 1/10th or less of the adjacent radius) near the bump locations 94, 96. The bump could be cylindrical or even flat, although some of the advantages would not be obtained. The bump contact 24 is shown formed by a part in the form of a rivet whose lower end is soldered at 104. It would be possible to instead deform the board 12 at a location where a bump is desired, and to plate that portion.

Figure 5:
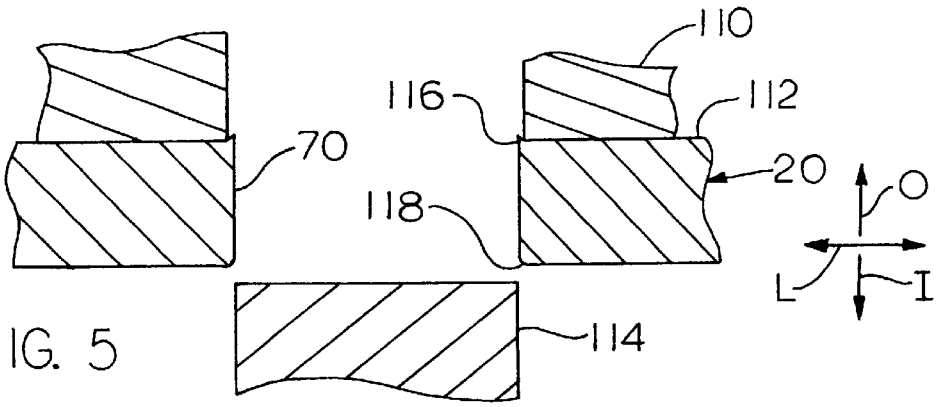
FIG. 5 is a partial sectional view, showing the manner in which the terminal of FIG. 3 is punched from a large piece of sheet metal.

FIG. 5 shows the manner in which applicant forms the slot 70 in the blade 20. Applicant prefers to place a die 110 on the outer face 112 of the sheet metal blade, and to move a punch 114 outwardly O through the sheet metal, to form the slot 70. Such punch out of the sheet metal results in a burr at 116 which lies on the outer O side of the blade, while the inner I side of the blade has a slightly rounded edge 118. The presence of a rounded edge 118 avoids the possibility that a burr will lie adjacent to the contact and possibly engage the contact and damage it.

As shown in FIG. 2, the main middle portion 76 of each blade includes parts bent outwardly (they can be bent inwardly) to form ribs 120, 122. The ribs extend along the length of the slot 20 and preferably slightly further, to stiffen the middle 56 of the blade. The ribs preferably do not extend rearwardly R much further (more than 30% more than the slot length) than the rear end of the slot 70, to avoid stiffening the elongated deflectable part 54 of the blade, which must bend to allow the middle and its tines to move away from and against the contact. Thus, while the elongated deflectable part 54 must be highly flexible, it is desirable that the main middle part 76 be rigid, and that only the tines 72, 74 be resiliently flexible.

Applicant has constructed and tested a terminal 16 of the construction illustrated, and found that it provided significantly higher reliability than prior terminals. The terminal was formed of beryllium copper sheet metal, with the punched-out terminal plated with nickel. The sheet metal had a thickness of 0.012 inch (0.30 mm). Each blade rear end portion had a width A of 0.136 inch (3.46 mm) and a length B of 0.386 inch (9.8 mm). The overall length C of the middle was 0.42 inch (10.5 mm). Each slot had a length D of 0.32 inch (8.1 mm) and a width E of 0.087 inch (2.2 mm). Each tine has a length F of 0.143 inch (3.6 mm) and a width G of 0.042 inch (1.1 mm). The contact or bump 24 has a radius of coverture H of 0.08 inch (2 mm).

Thus, the invention provides a deflectable switch terminal for mounting on a support, and a switch that includes the terminal and the support with at least one contact thereon, which assures more reliable engagement of each terminal blade with the contact. The blade is longitudinally elongated, and has a longitudinally-elongated rear end portion, immediately forward of where the blade is mounted, that is resiliently deflectable. The blade has a middle with a longitudinally-elongated slot that forms a longitudinally-elongated tine with one end merging with a middle portion that completely surrounds the slot and an opposite free end for engaging the contact. The slot is preferably of an elongated H-shape to provide two tines with adjacent free ends. The tines are bent so their free ends lie inward of their supported ends, with their free ends being curved. The tines result in two contact points for each contact, with wiping engagement at each contact point. The contact preferably has a largely spherical segment, with the free ends of the tine lying on opposite sides of the high point of the contact.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A switch comprising:

a support and a contact on said support, said support having longitudinally-spaced front and rear support ends;

a terminal comprising a sheet metal blade, said blade including a blade rear end portion having a blade mount fixed to said support and an elongated deflectable part that is unrestrained from bending, said blade including an opposite blade free front end portion forming a cam follower that can be deflected, and said blade including a middle lying longitudinally between said end portions with said middle lying over said contact to engage said contact when said free front end portion is deflected to move inward toward said contact;

said middle including an H-shaped slot that is elongated in a longitudinal direction and including a main middle portion surrounding said slot, said slot leaving a front tine with a front end merging with said main middle portion and with a free rear end, and said slot leaving a rear tine with a rear end merging with said main middle portion and with a free front end;

said rear end of said front tine and said front end of said rear tine each forming a blade contacting point, with each blade contacting point lying over said contact to engage said contact when said blade free front end is deflected inward.

2. The switch described in claim 1 wherein:

said support has a support surface lying substantially in a support surface plane and said contact is in a form of a bump having a substantially uniformly rounded convex upper surface with a high point lying furthest from said support surface plane;

said blade contact points are positioned to engage locations on said bump that lie on longitudinally opposite sides of said high point.

3. The switch described in claim 1 wherein:

said main middle portion has laterally opposite sides, with the sheet metal of said main middle portion at said opposite sides being bent upwardly to form stiffening ribs;

said H-shaped slot forming a gap between said free ends of said tines;

said stiffening ribs each having a length which is about the same length as said H-shaped slot, to bridge the gap formed by said H-shaped slot and stiffen said middle, while leaving said blade rear and front end portions resilient to bending.

4. The switch described in claim 1 wherein:

said blade is formed by punching it from a sheet of metal having inward and outward faces where the inward face will lie closest to said contact in the finished blade, using a punch and die of complementary shapes, where the die lies at said outward face of said sheet and said punch is moved against said inward face of said sheet and through said sheet, to leave a burr-free edge in said blade at said inward face.

5. The switch described in claim 1 wherein:

said support has a second contact part spaced from said contact;

said terminal includes a second sheet metal blade part that is part of the same piece of sheet metal that forms said blade, with said blade part having a blade part rear end portion that merges with said blade rear end portion, and with said blade part extending parallel to said blade and having a free front end and having a blade part middle with an H-shaped slot part forming tines lying over said second contact part.

6. A deflectable switch terminal for mounting on a support and for engaging a contact on the support, comprising:

a terminal comprising a piece of sheet metal forming a longitudinally-elongated blade, said blade having a blade rear end portion forming a blade mount for mounting on said support and forming a longitudinally-elongated deflectable part that can be resiliently bent, said blade deflectable part having a blade free front end portion that can be deflected, and said blade deflectable part having a blade middle with said blade deflectable part having a rear end that merges with said blade mount;

said blade middle having a longitudinally-elongated slot, and said blade middle forming a main middle portion that completely surrounds said slot, and said slot forming a longitudinally-elongated tine with a tine mount end merging with said middle portion and an opposite tine free end for engaging said contact;

said tine lying directly between said blade free front end and said blade deflectable part rear end.

7. The switch terminal described in claim 6 wherein:

most of said main middle portion lies in a plane and has opposite sides where sheet metal of said blade is bent out of said plane to form ribs to stiffen said main middle portion, but said ribs having rear ends lying rearward of the rear end of said tine but forward of a rear end of said deflectable part of said blade.

8. A deflectable switch terminal for mounting on a support and for engaging a contact on the support, comprising:

a terminal comprising a piece of sheet metal forming a longitudinally-elongated blade, said blade having a blade rear end portion forming a blade mount for mounting on said support and forming a longitudinally-elongated deflectable part that can be resiliently bent, said blade having a blade free front end portion that can be deflected, and said blade having a middle;

said blade middle having a longitudinally-elongated slot and said blade middle forming a main middle portion that completely surrounds said slot, with said slot being largely H-shaped and forming a pair of longitudinally-elongated tines that have longitudinally spaced mount ends merging with said main middle portion and having adjacent but longitudinally spaced free ends.

9. A combination of a support that has a contact and a switch terminal that is mounted on said support and that is engageable with said contact, wherein:

said switch terminal comprises a piece of sheet metal forming a longitudinally-elongated blade, said blade having a blade rear end portion forming a blade mount that is mounted on said support and forming a longitudinally-elongated deflectable part that can be resiliently bent, said deflectable part forming a pair of tines with adjacent but spaced free tine ends;

said support has a surface and said contact projects from said surface, said contact having a convex face facing said free ends of said tines, with said convex face having opposite sides and having a high point between said opposite sides where a location on said contact lies furthest from said surface of said support, and with said free ends of said tines lying over said opposite sides of said high point.

* * * * *